US005570516A

United States Patent [19]

Huang

[11] Patent Number: 5,570,516

[45] Date of Patent: Nov. 5, 1996

[54] DRYING SYSTEM HAVING CONTINUOUSLY CONNECTED CLOSE SPIRAL CONVEYERS

[76] Inventor: Ching-Yuan Huang, No. 2, Lane 24, Yangteh Ave., Sec. 1, Taipei, Taiwan

[21] Appl. No.: 499,836

[22] Filed: Jul. 10, 1995

[51] Int. Cl.[6] ..... F26B 11/04

[52] U.S. Cl. ..... 34/179; 34/180; 34/183

[58] Field of Search ..... 34/180, 182, 183, 34/179, 386, 387

[56] References Cited

U.S. PATENT DOCUMENTS

| | | | |
|---|---|---|---|
| 430,652 | 6/1890 | Jarrett | 34/183 |
| 3,837,271 | 9/1974 | Shore et al. | 34/182 |
| 4,209,911 | 7/1980 | Weber | 34/386 |
| 4,872,949 | 10/1989 | Wilwerding | 34/183 |
| 4,912,301 | 3/1990 | McKinney et al. | 34/183 |
| 5,321,900 | 7/1994 | Meyer | 34/180 |

FOREIGN PATENT DOCUMENTS

| | | | |
|---|---|---|---|
| 395190 | 2/1909 | France | 34/180 |

*Primary Examiner*—Edward K. Look
*Assistant Examiner*—Michael S. Lee
*Attorney, Agent, or Firm*—Bacon & Thomas

[57] ABSTRACT

Disclosed is a drying system having continuously connected close spiral conveyers mainly including a material mixer, a pump, a plurality of spiral conveyers connected end-to-end and zigzagging their way from top to bottom, a plurality of steam chambers around the mixer and the spiral conveyers, a container, a water tank, and a plurality of hoppers for receiving dried material. The material mixer has a stirring blade for stirring and loosening the material to be dried. The pump is connected to a bottom end of the mixer to suck the loosened material from the mixer and send it to the spiral conveyers to thereby further loosen and transport the material. Steam chambers surrounding the spiral conveyers are filled with hot steam to indirectly heat the material passing through the spiral conveyers. Automatic control valves are separately provided at a lower end of each spiral conveyer and are connected to a vacuum pump for sucking any moisture out of the spiral conveyers. The dried material is sent to the hoppers connected to a lower outlet of the lowest spiral conveyer for final packing and sealing into a container.

6 Claims, 3 Drawing Sheets

DRYING SYSTEM HAVING CONTINUOUSLY CONNECTED CLOSE SPIRAL CONVEYERS

BACKGROUND OF THE INVENTION

1. Field of the Invention

The present invention relates to a drying system having continuously connected close spiral conveyers, and more particularly to a drying system in which a plurality of substantially close spiral conveyers are connected end-to-end while they zigzag their way from top to bottom and are separately surrounded by a steam chamber so that some material passing the spiral conveyers is indirectly heated by the steam in the steam chambers and is evenly and thoroughly dried in the close spiral conveyers.

2. Description of the Prior Art

FIG. 1 illustrates a conventional tunnel drying system 1 which mainly includes an arcuated housing 11 provided at its surface with a plurality of through holes 12 and defining a passage 13 therethrough for a car 14 carrying material 15 to be dried to pass the housing 11 through the passage 13. A heater 16 is disposed outside the housing 11 such that the material 15 passing the housing 11 is directly heated by the heater 16. With this arrangements, the material 15 to be dried must be loaded on the car 14 in advance and then the car 14 is permitted to pass through the housing 11, permitting the material 15 to be heated by the heater 16 an become dried.

In such a conventional tunnel drying system 1, the material 15 is dried by means of direct heating. Since the material 15 is generally piled on the car 14 for heating, a portion of the material 15 exposed to the air or near an outer side of the pile is heated while the other portion thereof is not sufficiently heated. Moreover, since the material 15 is subjected to direct heating, it is difficult to precisely control the extend to which the material 15 is heated. It is possible the material 15 is either overheated or not sufficiently heated.

Therefore, the inventor has developed the present invention to eliminate the disadvantages existing in the conventional tunnel drying systems.

SUMMARY OF THE INVENTION

A primary object of the present invention is to provide a drying system having continuously connected close spiral conveyers in which a plurality of substantially close spiral conveyers connected end-to-end while zigzagging from top to bottom are provided to convey a material to be dried. Steam chambers are respectively provided to surround each spiral conveyer, such that the material conveyed by the spiral conveyers can be indirectly heated by the steam supplied to the steam chambers and be dried evenly.

Another object of the present invention is to provide a drying system having continuously connected close spiral conveyers in which a material mixer enclosed by a steam chamber is included to stir, loosen, and indirectly preheat the material to be dried before the material is sent to the spiral conveyers so that the material can be completely heated and dried later.

A further object of the present invention is to provide a drying system having continuously connected close spiral conveyers in which the material carried and conveyed by the spiral conveyers is continuously turned by the spiral conveyers when it passes the same, so that it is evenly heated at every sides thereof and fully dried by the steam supplied to the steam chambers.

BRIEF DESCRIPTION OF THE DRAWINGS

The above and other objects of the present invention as well as the detailed structure, functions, and applied principles of the present invention can be completely understood by referring to the following detailed description of the preferred embodiment and the accompanying drawings, wherein.

DETAILED DESCRIPTION OF THE PREFERRED EMBODIMENT

Figure 1:
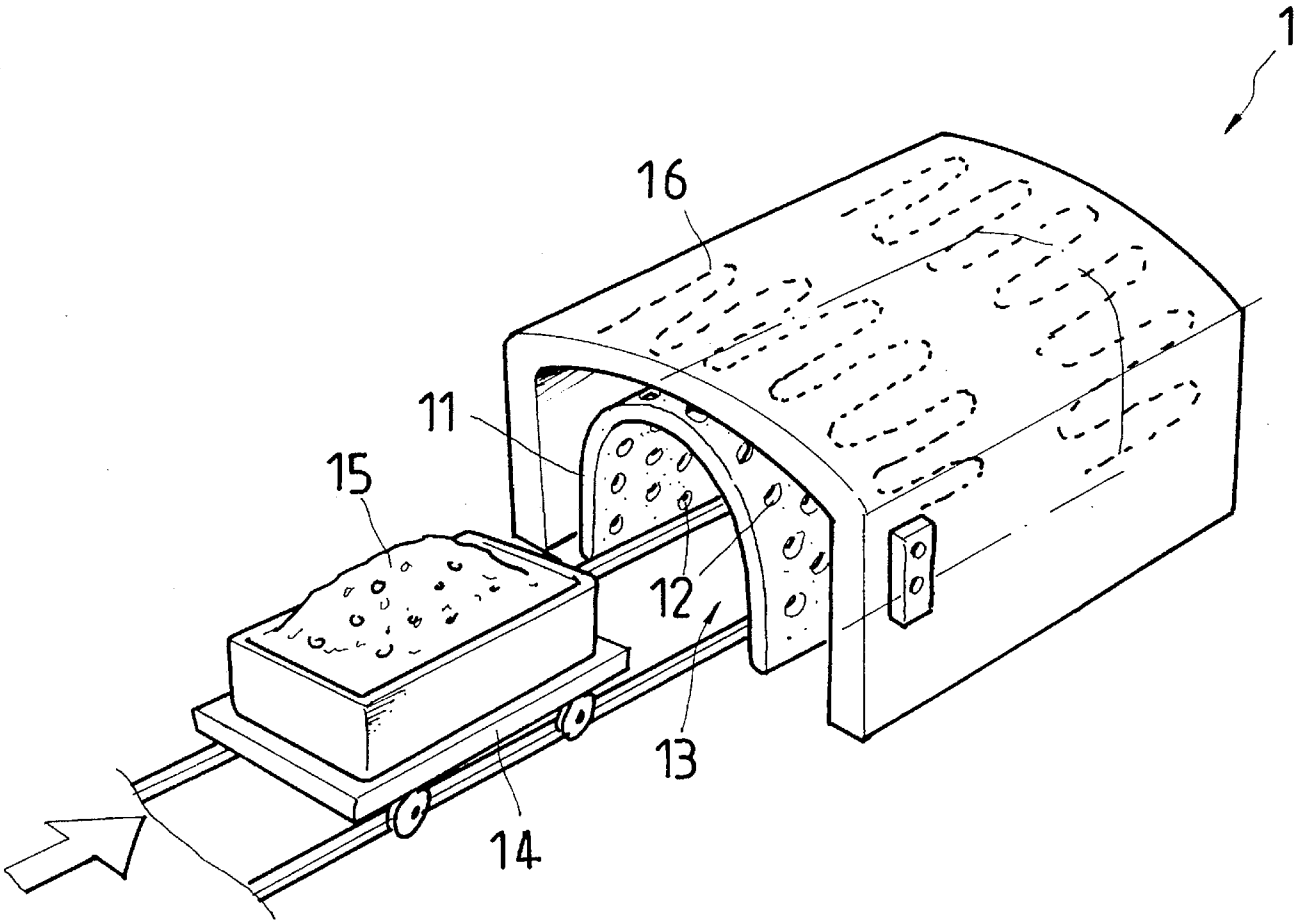
FIG.1 (PRIOR ART)
FIG. 1 is a perspective view showing a conventional tunnel drying system.
Figure 2:
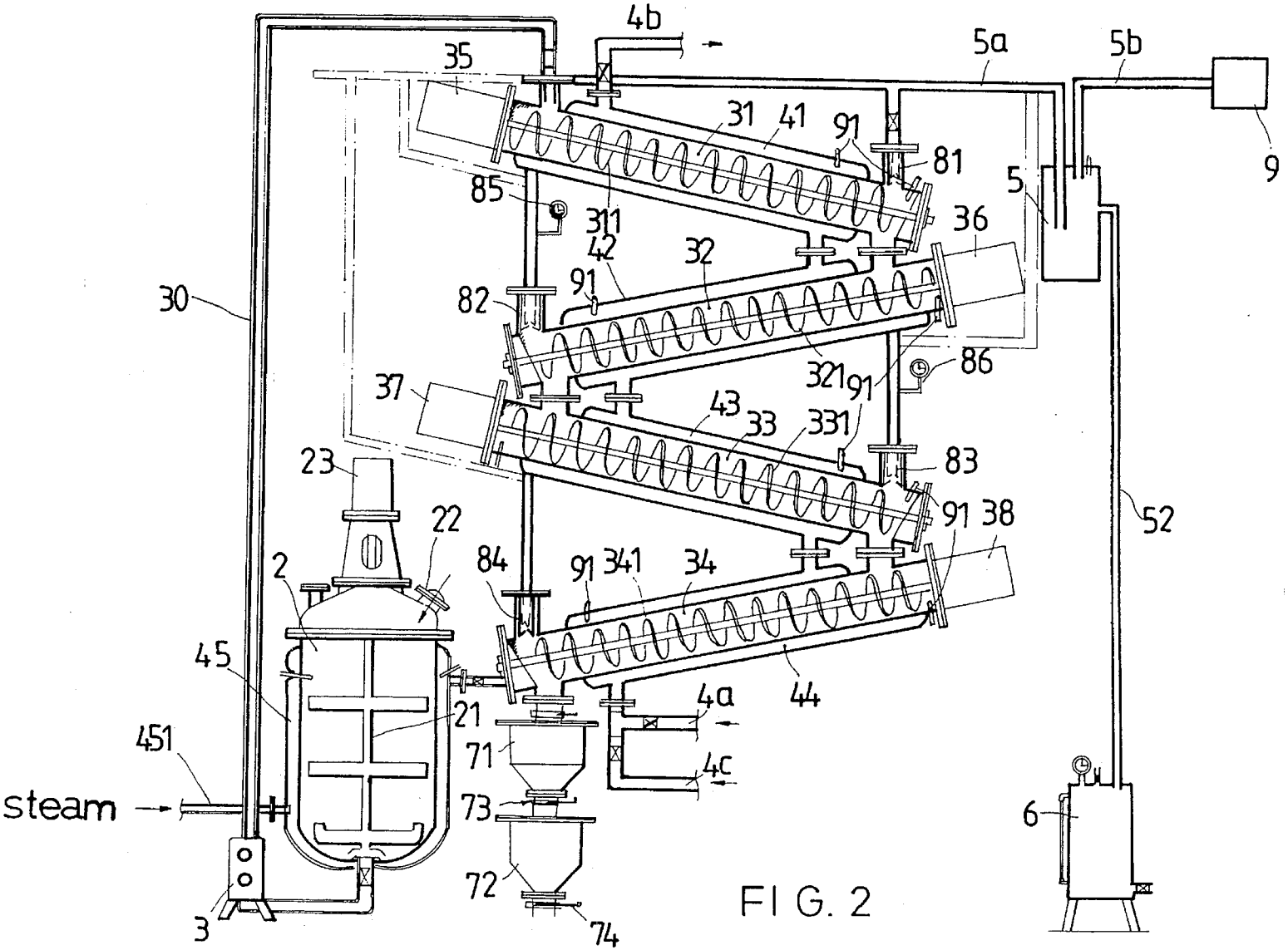
FIG. 2 is an elevational plan view of a drying system having continuously connected close spiral conveyers according to the present invention.

Please refer to FIG. 2. A drying system having continuously connected close spiral conveyers according to the present invention mainly includes a material mixer 2, a pump 3, a plurality of spiral conveyers 31, 32, 33, 34 connected end-to-end and zigzagging their way from top to bottom, a plurality of steam chambers 41, 42, 43, 44, 45, a container 5, a water tank 6, and a plurality of hoppers 71, 72.

The material mixer 2 has a plurality of stirring blades 21 provided inside the mixer 2 and a top cover 22 which can be opened or closed for feeding material to be dried into the mixer 2. A motor 23 is connected to a top portion of the mixer 2 for controlling the operation of the stirring blades 21. One steam chamber 45 is provided to surround the mixer 2 with a steam duct 451 connected thereto for introducing steam into the chamber 45.

The pump 3 is connected at one end to a bottom portion of the mixer 2 through a pipe to suck the material from the mixer 2 and send the sucked material via a material duct 30 connected to another end thereof to one of the spiral conveyers being disposed at the highest position of the drying system, that is, spiral conveyer 31 in this case. An electromagnetic valve is connected to the pipe between the pump 3 and the mixer 2 to control the time and the quantity at which the material is sucked from the mixer 2.

The spiral conveyers 31, 32, 33, and 34 are so arranged in the drying system that they zigzag in the system from top to bottom with every two vertically adjacent spiral conveyers communicably connected end-to-end, forming a continuous conveying passage in the drying system and allowing material to be dried to be continuously conveyed from the first and the highest spiral conveyer 31 to the last and the lowest spiral conveyer 34. Motors 35, 36, 37, and 38 are respectively connected to a beginning end of the spiral conveyers 31, 32, 33, and 34 to turn spiral blades 311, 321, 331, and 341 disposed inside the spiral conveyers 31, 32, 33, and 34, respectively. The hoppers 71, 72 are connected to an outlet at a lower end of the last and lowest spiral conveyer 34 to receive the dried material. Switches 73, 74 are respectively provided at a bottom portion of the hoppers 71, 72 to control the rate of the dried material flowing out of the hoppers 71, 72.

Steam chambers 41, 42, 43, and 44 respectively surround the spiral conveyers 31, 32, 33, and 34 and are designed to be communicable with one another. Steam is introduced into the steam chambers 41, 42, 43, and 44 via a steam duct **4*a*** and is led out of the steam chambers via a steam duct 4*b*. A duct 4*c* can be further led to the steam chambers to introduce cold water into the steam chambers to reduce the temperature inside the steam chambers. Automatic control valves 81, 82, 83, and 84 are respectively connected to a lower end of each spiral conveyer at an upper side thereof. Pipes are provided to separately interconnect the automatic control valves 81, 82, 83, and 84 with a duct 5*a* leading to the container 5. The container 5 is further provided with another duct 5*b* which leads to a vacuum pump 9 and a water pipe 52 leading to the water tank 6. Pressure gauges 85 and 86 are connected to the pipes interconnecting the automatic control valves 81, 82, 83, and 84 with the duct 5*a* so as to safely measure and indicate the inner pressure readings of these interconnecting pipes at any time.

Thermometers 91 are separately provided on the spiral conveyers 31, 32, 33, and 34 and on the steam chambers 41, 42, 43, and 44 to detect the temperatures inside these spiral conveyers and steam chambers at any time for duly control and regulation of their inner temperature.

Figure 3:
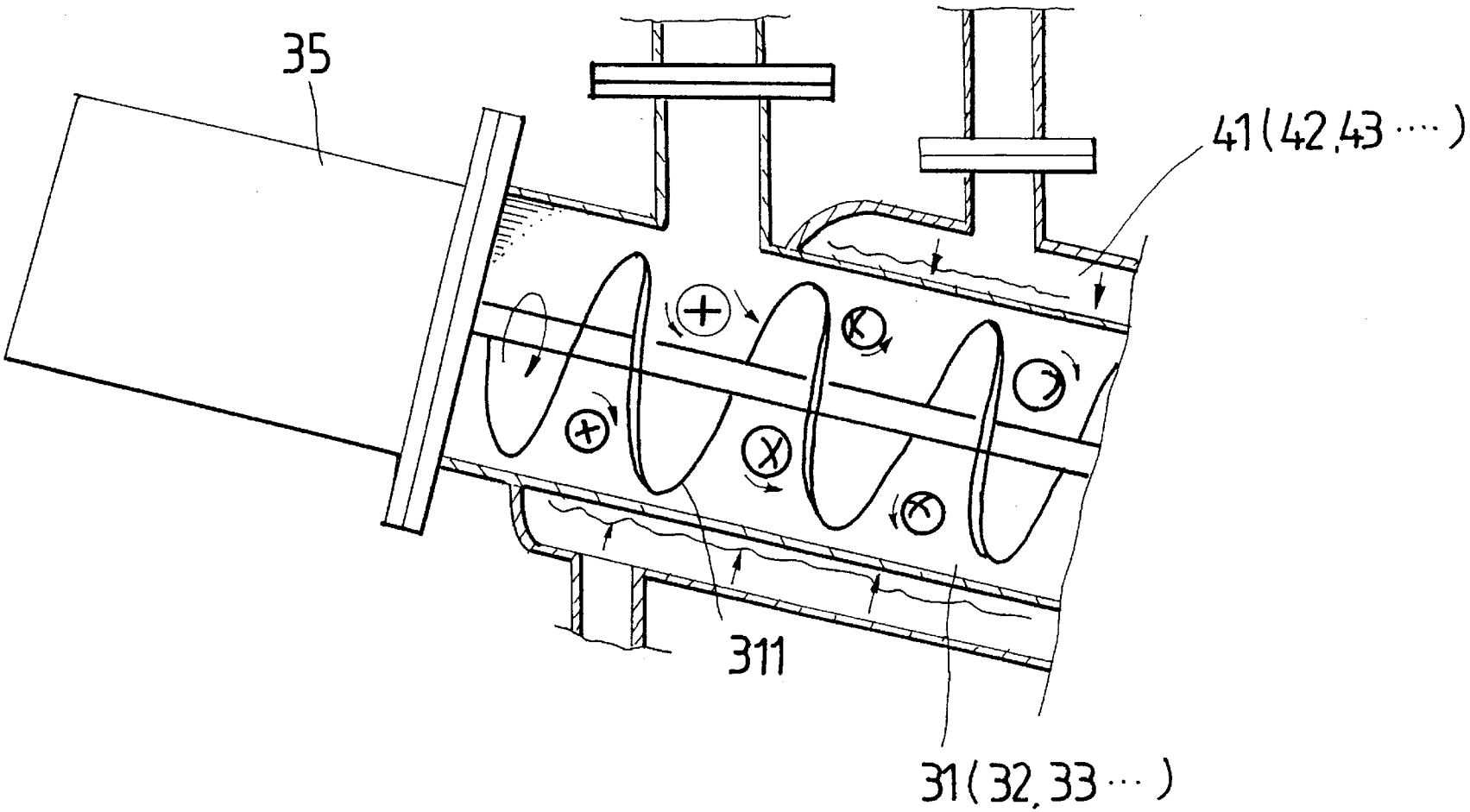
FIG. 3 is a fragmentary, enlarged, sectional view showing the manner in which the close spiral conveyer of the present invention works to stir and loosen the material passing through the conveyer for drying.

To use the drying system of the present invention, first put the material to be dried into the mixer 2. Stir and loosen the material in the mixer 2 by turning on the stirring blades 21. The material in the mixer 2 is preheated and predried by means of steam supplied into the steam chamber 45. The preheated material is then sucked out of the mixer 2 by means of the pump 3 and be sent to the first and the highest spiral conveyer 31 via the material duct 30. The spiral blade 311 inside the spiral conveyer 31 is driven by the motor 35 to rotate such that material sent thereto is loosely transferred to the next spiral conveyer 32. When the material is sent into the spiral conveyers 31, 32, 33, and 34 sequentially, the steam chambers 41, 42, 43, and 44 surrounding the spiral conveyers 31, 32, 33, and 34, respectively, are filled with steam at the same time to indirectly heat the material passing the spiral conveyers. As shown in FIG. 3, the material is indirectly heated at every sides thereof by the hot steam when it is loosely transferred by the rotating spiral blades 311, 321, 331, and 341 and is completely dried. The dried material is finally sent to the hoppers 71, 72 to be packed and sealed.

To prevent any condensate from forming in the spiral conveyers 31, 32, 33, and 34 after the same are indirectly heated by the steam in their respective surrounding steam chambers 41, 42, 43, and 44 and reversely affecting the drying of the material, the externally provided vacuum pump 9 is used to draw a vacuum in the ducts 5*a*, 5*b*, and the container 5. The automatic control valves 81, 82, 83, and 84 are used at the same time to suck any moisture from the spiral conveyers 31, 32, 33, and 34 and send the sucked moisture to the container 5 via the duct 5*a*. Steam so collected in the container 5 is sucked to the vacuum pump 9 via the duct 5*b* while droplets formed from the collected condensate are directed to the water tank 6 via the water pipe 52 and finally be drained.

To effectively control the temperature inside the spiral conveyers 31, 32, 33, and 34 and the steam chambers 41, 42, 43, and 44, the thermometers 91 disposed outside these conveyers,and chambers can be frequently checked to find the readings of temperature thereof. Whenever an overly high or an overly low internal temperature is found, hot steam or cold water can be immediately introduced into the steam chambers via duct 4*a* or duct 4*c*, respectively, to regulate the internal temperature of the steam chambers and/or the spiral conveyers.

With the above arrangements, it can be clearly seen that the material transferred by the spiral conveyers can be evenly and completely dried. In other words, the drying system having continuously connected close spiral conveyers according to the present invention dries the material in a more effective manner than the conventional tunnel drying systems did.

What is claimed is:

1. A drying system having continuously connected close spiral conveyers, comprising:

a material mixer having stirring blades therein;

a pump being connected to said material mixer at a bottom end thereof;

a plurality of substantially close spiral conveyers being connected end-to-end and zigzagging their way from top to bottom with the highest spiral conveyer thereof communicating with said pump by means of a material pipe extending between said pump and said highest spiral conveyer, said spiral conveyers each being provided at a beginning end with a motor and in an inner space with a set of spiral blades which are separately rotatable in said spiral conveyers when being driven by said motors;

a plurality of steam chambers being separately formed around said spiral conveyers and said material mixer; and at least one hopper being connected to a lower outlet of one of said spiral conveyers that is disposed at the end position thereof.

2. A drying system having continuously connected close spiral conveyers as claimed in claim 1, wherein each of said spiral conveyers is provided at a lower end with an automatic control valve leading to an external container via ducts.

3. A drying system having continuously connected close spiral conveyers as claimed in claim 2, wherein said external container is provided with a water pipe leading to a water tank and an outgoing duct leading to a vacuum pump.

4. A drying system having continuously connected close spiral conveyers as claimed in claim 2, wherein pressure gauges are separately connected to said ducts.

5. A drying system having continuously connected close spiral conveyers as claimed in claim 1, wherein thermometers are separately connected to said spiral conveyers and said steam chambers.

6. A drying system having continuously connected close spiral conveyers as claimed in claim 1, wherein said steam chambers provided around said spiral conveyers are temperature-adjustable by introducing hot steam or cold water into said steam chambers via different ducts.

* * * * *